US008242459B2

(12) United States Patent
Sun et al.

(10) Patent No.: US 8,242,459 B2
(45) Date of Patent: Aug. 14, 2012

(54) DEVICE FOR DESORPTION AND IONIZATION

(75) Inventors: Wenjian Sun, Shanghai (CN); Xiaohui Yang, Shanghai (CN); Li Ding, Manchester (GB)

(73) Assignee: Shimadzu Corporation (JP)

( * ) Notice: Subject to any disclaimer, the term of this patent is extended or adjusted under 35 U.S.C. 154(b) by 0 days.

(21) Appl. No.: 13/141,864

(22) PCT Filed: Dec. 29, 2009

(86) PCT No.: PCT/CN2009/076175

§ 371 (c)(1),
(2), (4) Date: Jun. 23, 2011

(87) PCT Pub. No.: WO2010/075769

PCT Pub. Date: Jul. 8, 2010

(65) Prior Publication Data

US 2011/0253903 A1 Oct. 20, 2011

(30) Foreign Application Priority Data

Dec. 30, 2008 (CN) ..... 2008 1 0188989

(51) Int. Cl.
*H01J 27/08* (2006.01)
*H01J 49/04* (2006.01)
*H05H 1/24* (2006.01)

(52) U.S. Cl. ..... 250/425; 250/426; 250/428; 250/288; 315/111.21; 315/111.01; 438/513

(58) Field of Classification Search ..... 250/425, 250/426, 428, 288; 315/111.21, 111.01; 438/513

See application file for complete search history.

(56) References Cited

U.S. PATENT DOCUMENTS 7,544,933 B2 * 6/2009 Cooks et al. ..... 250/288

(Continued)

FOREIGN PATENT DOCUMENTS

CN 101201335 A 6/2008

OTHER PUBLICATIONS

Jason D. Harper et al., Low-Temperature Plasma Probe for Ambient Desorption Ionization, Analytical Chemistry, Dec. 1, 2008, p. 9097-9104, vol. 80, No. 23.

(Continued)

*Primary Examiner* — Nikita Wells

(74) *Attorney, Agent, or Firm* — Norris, Manning & Martin, LLP; Tim Tingkang Xia, Esq.

(57) ABSTRACT

The current invention involves a desorption corona beam ionization source/device for analyzing samples under atmospheric pressure without sample pretreatment. It includes a gas source, a gas flow tube, a gas flow heater, a metal tube, a DC power supply and a sample support/holder for placing the samples. A visible corona beam is formed at a sharply pointed tip at the exit of the metal tube when a stream of inert gas flows through the metal tube that is applied with a high DC voltage. The gas is heated for desorbing the analyte from solid samples and the desorbed species are ionized by the energized particles embedded in the corona beam. The ions formed are then transferred through an adjacent inlet into a mass spectrometer or other devices capable of analyzing ions. Visibility of the corona beam in the current invention greatly facilitates pinpointing a sampling area on the analyte and also makes profiling of sample surfaces possible.

15 Claims, 4 Drawing Sheets

U.S. PATENT DOCUMENTS

| | | | | |
|---|---|---|---|---|
| 7,714,281 | B2 * | 5/2010 | Musselman | 250/288 |
| 2007/0187589 | A1 | 8/2007 | Cooks et al. | |
| 2012/0037797 | A1 * | 2/2012 | Li et al. | 250/282 |

OTHER PUBLICATIONS

Lucy V. Ratcliffe et al., Surface Analysis under Ambient Conditions Using Plasma-Assisted Desorption/Ionization Mass Spectrometry, Analytical Chemistry, Aug. 15, 2007, p. 6094-6101, vol. 79, No. 16.
Charles N. McEwen et al., Analysis of Solids, Liquids, and Biological Tissues Using Solids Probe Introduction at Atmospheric Pressure on Commercial LC/MS Instruments, Analytical Chemistry, Dec. 1, 2005, p. 7826-7831, vol. 77, No. 23.
Robert B. Cody et al., Versatile New Ion Source for the Analysis of Materials in Open Air under Ambient Conditions, Analytical Chemistry, Apr. 15, 2005, p. 2297-2302, vol. 77, No. 8.
Na Na et al., Development of a Dielectric Barrier Discharge Ion Source for Ambient Mass Spectrometry, J Am Soc Mass Spectrom, 2007, p. 1859-1862, vol. 18.
Zoltan Takats et al., Mass Spectrometry Sampling Under Ambient Conditions with Desorption Electrospray Ionization, Science, Oct. 15, 2004, p. 471-473, vol. 306.
Francisco J. Andrade et al., Atmospheric Pressure Chemical Ionization Source. 1. Ionization of Compounds in the Gas Phase, Analytical Chemistry, 2008, p. 2654, vol. 80.

* cited by examiner

DEVICE FOR DESORPTION AND IONIZATION

FIELD OF THE INVENTION

The current invention generally relates to desorption and ionization technique under atmospheric pressure and room temperature, and more particularly to a device that utilizes a corona beam for desorption and ionization of the analytes.

BACKGROUND OF THE INVENTION

With the widespread use of Liquid Chromatography-Mass Spectrometry (LC-MS) systems for analyzing complex mixture of compounds around the world, ionization sources working under atmospheric pressure such as Electrospray Ionization (ESI) and Atmospheric Pressure Chemical Ionization (APCI) sources have been playing very important roles in the fields of food safety, environment protection and homeland security. However, the time consuming processes of sample pretreatment before conducting any analysis in a mass spectrometer prevent the techniques from being implemented on site with high speed. This issue was addressed and partially solved with the emergence of some pioneering direct analysis methods such as Desorption Electrospray Ionization (DESI) (Science, Vol. 306, page 471 (2004)) and Direct Analysis in Real Time (DART) (Analytical Chemistry, Vol. 77, page 2297 (2005)).

The two techniques use either charged droplets formed from the electrospray process (DESI) or mixture of ions and metastable gas molecules from a discharge chamber to interact with the analytes on a solid surface and bring the formed ions into a mass spectrometer. In DART the ions and metastable species from the source probe is also able to ionize vapors from a volatile sample directly.

A large number of techniques with the capability of ionizing samples under the atmospheric pressure without sample preparation have appeared since then. Atmosphere Solid Analysis Probe (ASAP) (Analytical Chemistry, Vol. 77, page 7826 (2005)) and Desorption Atmospheric Pressure Chemical Ionization (DAPCI) (US publication No. 2007/0187589) are another two methods closely related to the present invention. In ASAP a gas stream from a commercial source probe was heated and directed towards a solid sample located near the exit of a gas tube and the entrance of a mass spectrometer. The desorbed analyte were then ionized by a corona discharge needle nearby and delivered into the mass spectrometer. In the DAPCI method a stream of high speed gas was ionized when it exits a capillary tube with a sharp needle protruding from within. The ionization process in this case is the result of interaction between the ions formed by the corona discharge and the neutral species on the surface.

The three methods (DART, ASAP, and DAPCI) discussed above all involve using a DC voltage to generate a corona discharge from a sharp needle for creating ions to interact with samples either in the gas phase or in the condensed phase. One limitation for these corona discharge based methods is that the plasma is only visible at the tip of the discharge needle and therefore the sampling area for the analyte is very uncertain. Other direct analysis methods based on plasma technologies were also developed since 2005 and they do not have similar problems.

For example, Plasma-assisted Desorption Ionization (PADI) (Analytical Chemistry, Vol. 79, page 6094 (2007)) and Flowing Afterglow—Atmospheric Pressure Glow Discharge (FA-APGD) (Analytical Chemistry, Vol. 80, page 2654 (2008)) are the two techniques utilizing glow discharge as the source for generating ions from vapor/solid surface directly. Both methods use He as the discharge gas and share similar discharge current (tens of milliamps). In PADI the glow discharge was generated by a RF voltage with amplitude of hundreds of voltages whereas in FA-APGD a DC voltage of 500 V was used. Unlike those corona discharge based sources described previously, the glow discharge based sources such as PADI and FA-APGD normally have luminous plasma which extends from the exit of the gas to the sample, which makes the alignment of the sampling area easy.

Another type of direct analysis methods involving using the plasma as the ionization probe was developed recently in both Xinrong Zhang (Dielectric Barrier Discharge Ionization (DBDI)) (Journal of American Society for Mass Spectrometry, Vol. 18, page 1859 (2007)) and Graham R. Cooks' (Low Temperature Plasma (LTP), Analytical Chemistry, Vol. 80, page 9097 (2008)) groups. Both techniques share very similar mechanism though the geometries are different. As the names indicated, the two methods use dielectric barrier discharge to generate ions from the ambient air for further ionization of analytes on a surface, and the plasma from the discharge has a temperature close to the ambient temperature. RF voltages with amplitude of several kVs were used in these cases. Again, the plasma generated by this mechanism is visible and could be used for alignment purpose.

However, almost all the techniques described above with luminous plasma require high amplitude RF voltages and this makes the modification difficult for the current commercial ion source based on APCI and ESI which all use DC voltage for ionization. The only exception is the FA-APGD method which uses a DC voltage to initiate the glow discharge. This method though would need a chamber filled with He gas which increases the complexity of the source modification and also the temperature of the plasma is very high (400~700° C.) that makes the control of experimental conditions difficult.

Therefore, a plasma ionization source for direct analysis is desired with minimum modification to the commonly available ambient ionization source such as APCI, and better yet this source is desired to render the possibility of generating a visible and extending plasma in order to easily locating the sampling areas.

SUMMARY OF THE INVENTION

The demand mentioned above can be met by a system of Desorption Corona Beam Ionization (DCBI) where a luminous plasma stream (a corona beam) caused by corona discharge was used for desorption/ionization of analytes from a solid surface under the atmospheric pressure.

This invention relates to an ionization source. In one embodiment, it includes a gas source, a gas flow tube, a gas flow heater, a metal tube, a DC power supply and a sample support for placing the samples. The gas source provides gas with pressure above one atmospheric pressure. The gas flow tube transfers gas from the gas source mentioned above. The gas flow heater heats up the gas from the gas source. The metal tube connects with the gas flow tube through the gas flow heater. It exports the heated gas to the exit of the tube which has a sharply pointed tip. A direct current voltage supply supplies a high voltage to the metal tube. A sample holder holds a sample in front of the tip outlet of the metal tube and being adjacent to an inlet of a mass spectrometer or other devices capable of analyzing ions. A corona beam is formed from the heated gas at the tip of the metal tube and extending towards the sample surface where at least part of the sample materials is desorbed and then ionized by reactions with energized particles from the corona beam.

The corona beam formed at the tip of the metal tube extends out for 8 to 12 mm and goes through a ring electrode which serves as the counter electrode for the corona discharge. The corona beam appears to be visible with a sharp tip at the very end. Hence, the sampling area can be observed when the tip of the beam scans across the surface of a solid sample, which facilitates locating of the sampling areas and helps avoid any interference from the uninterested portion of the sample.

Optionally, water or other organic solvents can be infused into the metal tube through the heater in order to both stabilize the corona stream and enhance the ionization efficiency of the source.

The desorption and ionization source mentioned in this invention generates the visible corona beam under atmospheric pressure using voltage and current supplied by a common commercial ion source. The visible corona beam has greatly facilitated locating and mapping the sample surface.

BRIEF DESCRIPTION OF THE DRAWINGS

The accompanying drawings illustrate one or more embodiments of the invention and, together with the written description, serve to explain the principles of the invention.

DETAILED DESCRIPTION OF THE INVENTION

Figure 1:
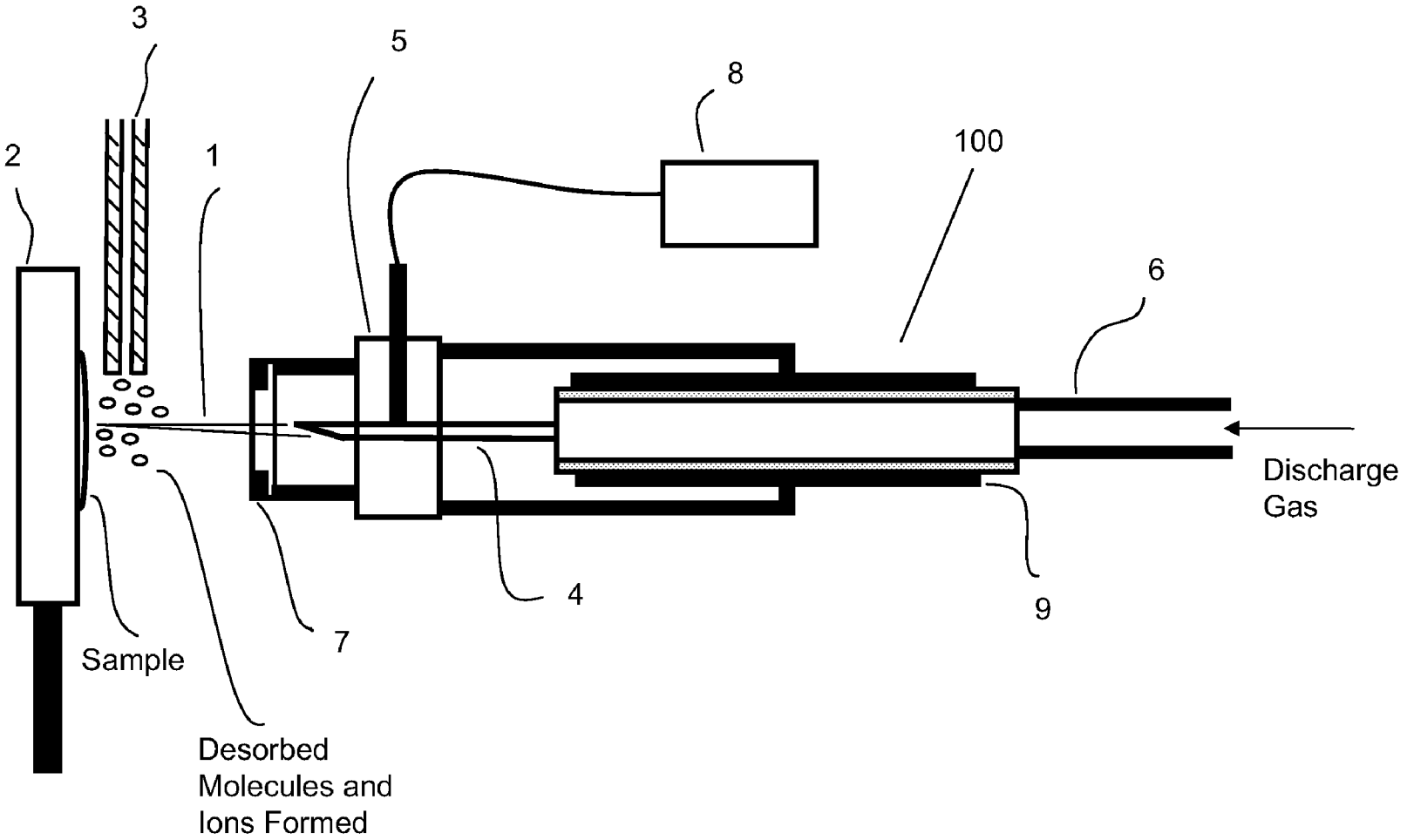
FIG. 1 is a schematic view of a system/device for desorption corona beam ionization according to the current invention.

The schematics of the DCBI source is shown in FIG. 1 and it includes a sample probe 100 for generating the corona beam 1, a sample support 2 for placing the samples, and an ion inlet 3 for introducing the ions formed into a device capable of ion analysis. The corona beam 1 was formed by applying a direct current voltage (2~5 kV) to the tip of the metal tube 4 when a stream of gas (preferably He) flows through the metal tube 4 at a rate ranging from 1 to 2 L/min. The supplied gas can be heated to 150~350° C. before it reaches the sample support 2 for thermally desorbing the analytes. The desorbed gaseous species are ionized by interaction with energetic particles generated in the corona discharge under the atmospheric pressure. The ions formed are then delivered into a mass spectrometer or other devices through the ion inlet 3 for further analysis.

The solid analytes need to be thermally desorbed from the surface first. Therefore the samples normally are volatile or semi-volatile compounds. The ionization mechanism is postulated that it would involve the interaction of the analytes desorbed from the surface with metastable He atoms, He ions directly formed from the discharge, and the ions formed by collisions between the metastable species with the ambient gas molecules.

As shown in FIG. 1, one end of the metal tube 4 was shaped into a sharply pointed tip and the tip points towards the sample. The metal tube 4 can have an o.d. of 0.7~1.5 mm (0.9 mm preferred) and i.d. of 0.3~1.2 mm (0.5 mm preferred). The metal tube 4 is inserted into a machinable ceramic adaptor 5 which serves as a gas tight connection between the gas flow tube 6 and the metal tube 4. Another function of the adaptor 5 is to provide electrical insulation for the high voltage connection and the counter electrode 7. The high voltage connection was made through a side hole in the adaptor 5 and it connects the metal tube 4 with the external high voltage power supply 8. The counter electrode 7 was mounted on the top of the adaptor 5 (near the sample side) and is 3~7 millimeters away from the tip of the metal tube 4. The counter electrode 7 has a round opening at the center in order to let the gas stream pass through. The diameter of the opening is preferably to be 4~6 mm. The counter electrode has a thickness between 0.5 and 3 mm.

There are two kinds of the gas flow heater 11 heating gas. One is ceramic heater which generates the heat by a resistive heating wire winding around the outside of the ceramic heater. The other is thin-walled metal tube which generates the heat by a huge current supplied on the tube. In other words, the tube is a resistor heater. As far as the second one is concerned, the advantage is that the heater has small heat capacity and the temperature change of the heated gas can be very fast. This makes fast temperature adjustment of the source much easier.

The discharge gas was provided by a gas tank through a pressure gauge that can be used to control the flow rate of the gas either by hands or by a computer. The discharge gas is preferably helium for better visibility of the corona beam, but other inert gas such as Argon can also be used. Both the solvent and gas delivery system (such as gas source, gas flow tube 6, solvent line 12, metal tube 4) along with the heater 9 can be adapted from a commercial APCI source, but it can also be made in house from the parts described above.

The discharge voltage can be between 2 to 5 kV and it was provided with a high voltage DC power supply 8. The internal resistance of the power supply 8 should be large (over 100 MΩ) in order to limit the current during the corona discharge and to sustain a stable beam of plasma. The current flowing through the tip of the metal tube 4 can be between 2 to 20 μA and the value is closely related to the flow rate of the solvent. The tens of microampere of electric current could be supplied by a power supply of a commercial APCI source.

The solvent was delivered into the gas flow tube 6 with a liquid chromatography (LC) pump or with a syringe pump for direct infusion. The solvent can be various organic solvent/solvent mixtures or simply water for different applications. The gas flow tube 6 was equipped with a resistive heater 9 which can provide a temperature up to 500° C., and therefore the solvent can be vaporized before it reaches the metal tube 4 if the temperature of the heater 9 is sufficiently high. The flow rate for solvents generally should be between 10 and 100 uL/min for a stable corona beam 1. Within this range increasing the flow rate could significantly decrease the current of the corona discharge and increase the stability of the corona beam 1. The solvent was applied also due to the fact it can provide gaseous ions (hydronium ions in the case of water as the solvent) for subsequent reaction with the desorbed analyte molecules and therefore increase the ionization efficiency of the source. At the same time, the solvent is applied because it can stabilize the corona beam 1 and prevent the plasma from flickering.

The detachment of the sample from solid surface is a thermal desorption process. Therefore, the temperature of the heater 9 is essential for determining the desorption efficiency. For samples with high volatility such as Dichlorovos and Dimethoate, 150° C. (on the heater 9) is enough for desorption, whereas for samples with relatively low volatility such as Fenvalerate, 350° C. (on the heater 9) is the optimum temperature. It is important to note that when the temperature on the heater 9 is increased, the stability of the corona beam 1 will decrease. This is probably due to the fact that higher temperature causing lower number density of the gas molecules in the discharge region therefore increasing the local field strength (E/N) and disturbing the corona discharge. However, this destabilization effect of the temperature can be compensated by applying solvent vapor to the gas flow tube 6.

To decrease the influence of discharge stability caused by temperature change of gas flow and to increase the desorption efficiency, a laser beam was used for irradiating on sample surface as an auxiliary desorption method. The laser beam could be infrared laser with continuous wavelength or pulsed infrared or UV laser. Using this mode, power supply of the gas flow heater 11 will be switched off, thus desorption process will be solely relied on the laser. The power supply of gas flow heater 11 can also be switched on to realize desorption process by both laser and gas flow.

Once all the conditions were met, a corona beam 1 can be generated at the sharply pointed tip of the metal tube 4 and it can be extended out for about 1 cm with a diameter of around 0.5~1.5 mm. (The diameter of corona beam 1 is related to the i.d. of metal tube.) The corona beam 1 normally appeared to be blue and turned to more purple when water was used as the solvent. The corona beam 1 has a sharp tip at the end and the sampling spot (as shown in FIG. 1 on the left side of the corona beam) can be easily visualized when the tip scans through the surface of a solid sample which helps locating the specific area of analysis.

The angle of the corona beam 1 relative to the sample support 2 can be from close to 0° up to 90° with 90° as the preferred angle due to the finest sampling area associated with this angle. The ion inlet 3 of the mass spectrometer or other devices capable of ion analysis should be close to the sampling spot (within 5 mm) in order to maximize the number of ions delivered. The sample support 2 can be made of various materials which include but not limited to metal and ceramics.

Ceramics is the preferred material since it has low thermal conductivity for good local heating efficiency and has high heat resistance. For solid samples the analyte can be clipped onto the sample support 2, whereas for sample solution the liquid can be dipped and dried directly on the sample support 2. A slice of a solid sample can be attached to the sample support 2 and mapped with the tip of the corona beam 1 if the profiling information of the sample surface is required.

Negative mode of the source works in a similar fashion as the positive mode does. The operating conditions can be kept the same except switching the polarity of the power supply 8. Certain compounds with high electronegativity such as TNT and PETN appear to have better signal in the negative mode.

Figure 2:
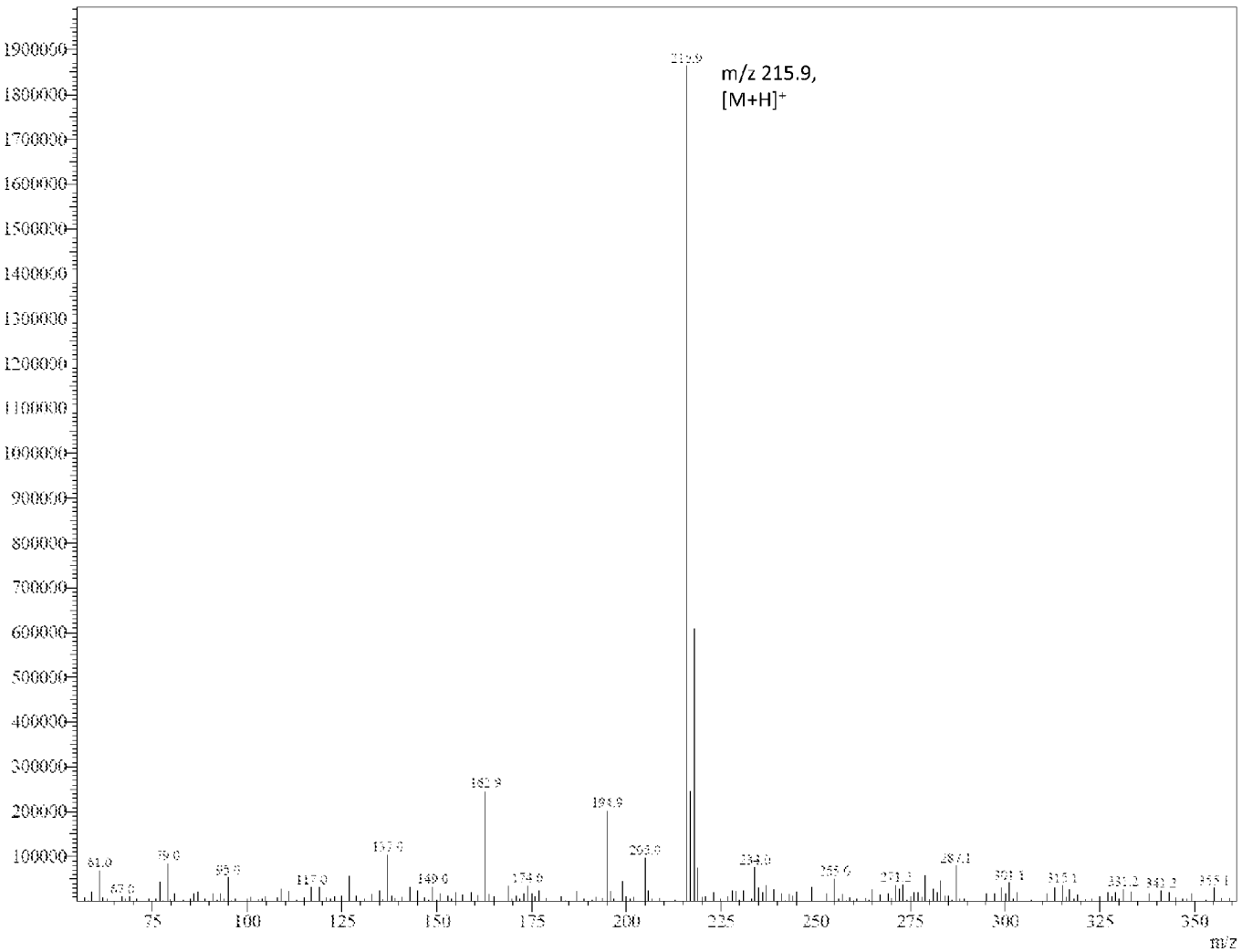
FIG. 2 shows the mass spectrum of atrazine deposited on a ceramic substrate and ionized with the corona beam (heated to 200° C.) in the positive mode.

FIG. 2 shows the mass spectrum of atrazine in positive mode and the data is acquired when 1 ng of the analyte is dipped onto a ceramic sample support 2 and is sampled at 2.5 kV source voltage, 50 uL/min solvent ($H_2O$) of flow rate, and 2 L/min of He flow. The temperature of the source heater 9 is maintained at 200° C. during the operation.

Figure 3:
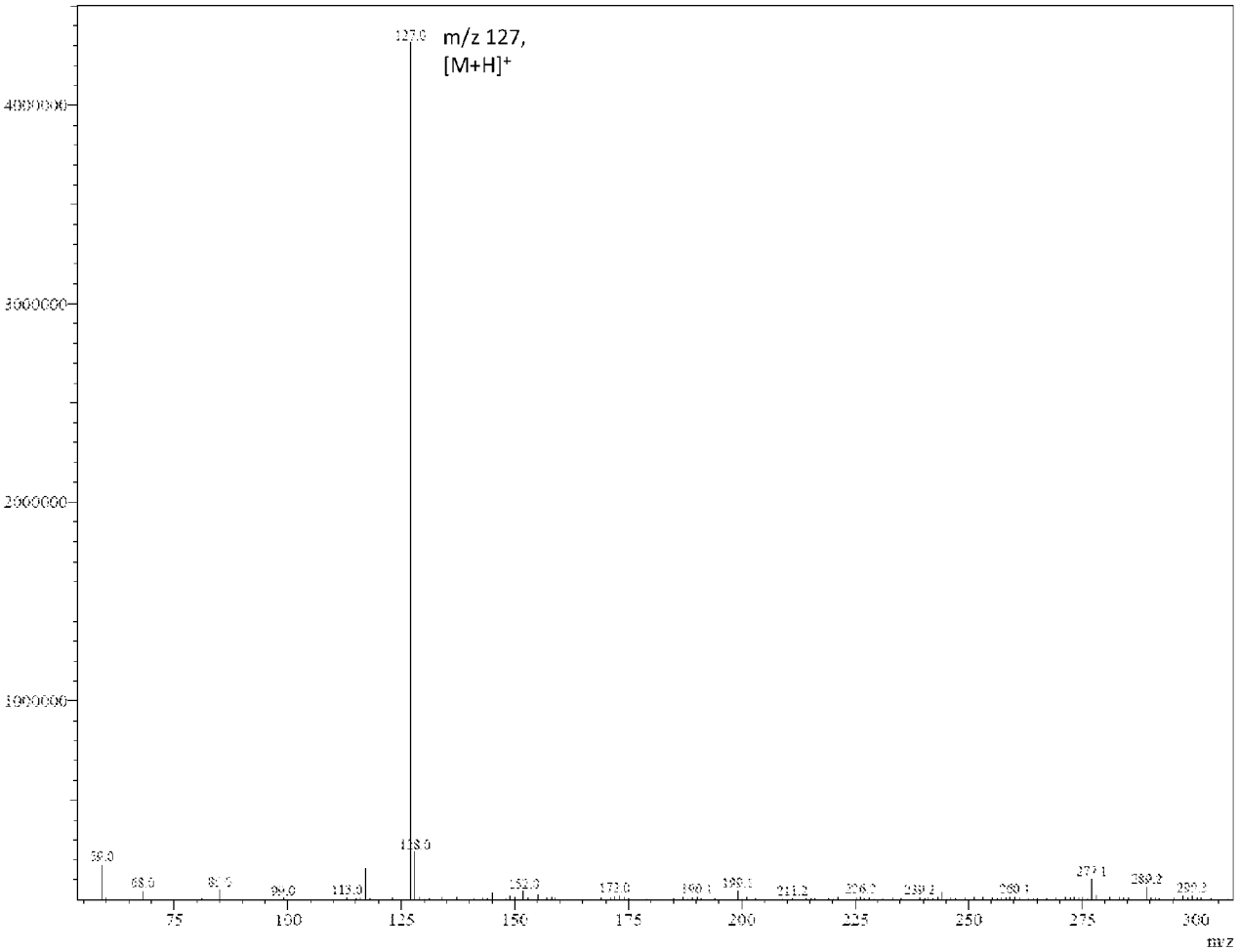
FIG. 3 shows the mass spectrum of melamine deposited on a ceramic substrate and ionized with the corona beam (heated to 350° C.) in the positive mode.

FIG. 3 shows the mass spectrum of melamine in positive mode and the data was acquired when 1 ng of the analyte is dipped onto the ceramic sample support 2. The temperature of the source heater 9 is maintained at 350° C. and other operating conditions are the same as the ones used for obtaining the results shown in FIG. 2.

Figure 4:
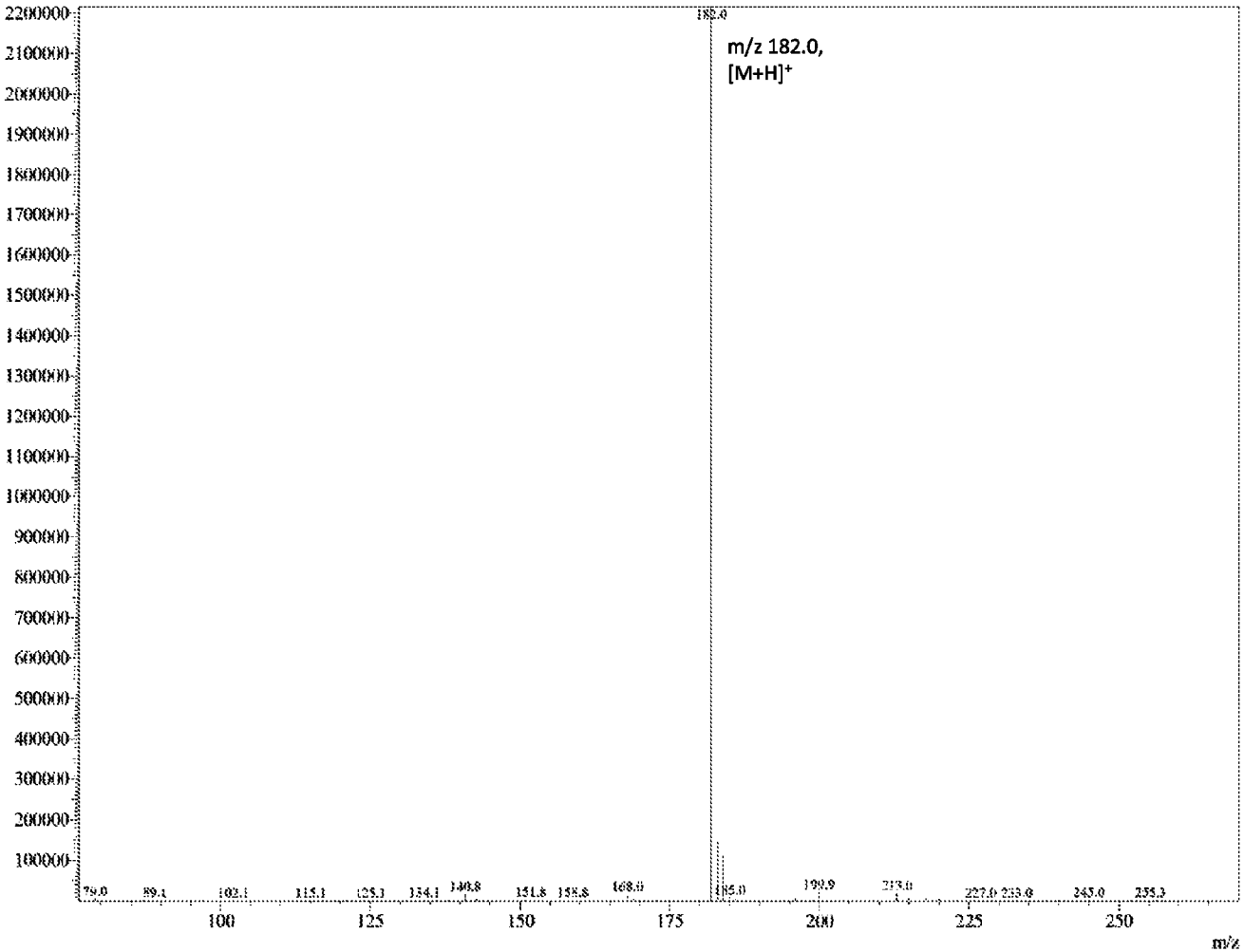
FIG. 4 shows the mass spectrum of acephate deposited on a ceramic substrate and detected with corona beam (heated to 350° C.) in negative mode.

FIG. 4 shows the mass spectrum of acephate in negative mode. The operating conditions are the same as the ones used for obtaining the results shown in FIG. 3 except that the source voltage is −2 kV instead of 2.5 kV.

The results shown above indicate that the DCBI source described in the current invention is capable of analyzing volatile and semi-volatile samples directly from solid surface. The visible corona beam 1 does provide the ease of locating and mapping the sample surface and therefore make profiling of the sample slice possible.

It should also be seen that variations and modifications of the present invention additional to the embodiments described herein are within the spirit of the invention and the scope of the claims. For example, the tip of exit of metal tube could be more than one to increase the discharge efficiency, the inner opening of counter electrode could be not only round but also other polygons; sample holder and the beam position could be adjusted on x, y and z side to analyze sample with different size.

What is claimed is:

1. A device for desorption and ionization, comprising:

a gas source for providing gas having pressure greater than one unit of atmospheric pressure;

a gas flow tube for transferring the gas from the gas source;

a gas flow heater for heating up the gas from the gas source;

a metal tube connected to the gas flow tube through the gas flow heater for transferring the heated gas to its exit of the metal tube, the metal tube having a sharply pointed tip at the exit;

a direct current (DC) voltage supply for supplying a high voltage to the metal tube; and a sample holder for holding a sample in front of the tip of the metal tube and being adjacent to an inlet of a mass spectrometer, wherein when the high voltage from the DC voltage supply is applied to the metal tube, a corona beam is formed from the heated gas at the tip of the metal tube and extends towards the surface of the sample, whereby at least portions of the sample are desorbed and then ionized by reactions with energized particles from the corona beam.

2. The device of claim 1, wherein the metal tube has an inner diameter between 0.3 mm and 1.2 mm.

3. The device of claim 1, wherein the DC power supply supplies a DC voltage ranging from 2 to 5 kV.

4. The device of claim 1, further composing a counter electrode located at 3-7 mm from the front of the tip of the metal tube for stabilizing the corona beam.

5. The device of claim 4, wherein the counter electrode has an inner hole with a diameter of 4~6 mm.

6. The device of claim 1, wherein water or organic solvent is applied to the gas flow tube, wherein the water or solvent is vaporized by the flow heater and transferred to the corona beam in the sampling region.

7. The device of claim 6, wherein the flow of the solvent is in the range of 10-100 μL/min.

8. The device of claim 1, wherein the gas flow heater is operated at a temperature between 150° C. and 500° C.

9. The device of claim 1, wherein the sample holder is made of metal and/or ceramics.

10. The device of claim 1, wherein the ions formed by the reaction with energized particles from the corona beam are delivered into the mass spectrometer for analysis.

11. The device of claim 1, wherein the sample holder is movable so that the tip of the corona beam scans across the surface of the sample for obtaining surface profiling information.

12. The device of claim 1, wherein the gas flow heater comprises a ceramic tube and a resistive heating wire winding around the ceramic tube for heating thereof.

13. The device of claim 1, wherein the gas flow heater comprises a thin-walled metal tube heated with a large current applied on the tube.

14. The device of claim 1, wherein a laser is applied for desorption by irradiating the surface of the sample with its laser beam.

15. The device of claim 1, wherein the corona beam and the sample are positioned in an enclosure that is filled with dried gas including nitrogen or argon during operation of the device.

* * * * *